US007669645B2

(12) United States Patent
Nakamura

(10) Patent No.: US 7,669,645 B2
(45) Date of Patent: Mar. 2, 2010

(54) HEAT EXCHANGER

(75) Inventor: Yoichi Nakamura, Nagoya (JP)

(73) Assignee: T. Rad Co., Ltd., Shibuya-Ku, Tokyo (JP)

( * ) Notice: Subject to any disclaimer, the term of this patent is extended or adjusted under 35 U.S.C. 154(b) by 43 days.

(21) Appl. No.: 11/664,192

(22) PCT Filed: Sep. 27, 2005

(86) PCT No.: PCT/JP2005/018260

§ 371 (c)(1),
(2), (4) Date: Mar. 28, 2007

(87) PCT Pub. No.: WO2006/035988

PCT Pub. Date: Apr. 6, 2006

(65) Prior Publication Data

US 2008/0087409 A1 Apr. 17, 2008

(30) Foreign Application Priority Data

Sep. 28, 2004 (JP) ..... 2004-281862

(51) Int. Cl.
*F28F 9/02* (2006.01)
*F28D 7/02* (2006.01)

(52) U.S. Cl. ..... 165/173; 165/165; 165/157

(58) Field of Classification Search ..... 165/157, 165/158, 164, 165, 167, 173
See application file for complete search history.

(56) References Cited

U.S. PATENT DOCUMENTS 2,019,351 A * 10/1935 Lathrop ..... 165/165
3,734,177 A * 5/1973 Bellovary et al. ..... 165/166
4,473,111 A 9/1984 Steeb
5,111,671 A 5/1992 Kadle
5,282,507 A * 2/1994 Tongu et al. ..... 165/165
5,720,341 A 2/1998 Watanabe et al.
6,016,865 A 1/2000 Blomgren
6,059,023 A * 5/2000 Kurematsu ..... 165/165

(Continued)

FOREIGN PATENT DOCUMENTS

EP 0 942 156 9/1999

(Continued)

*Primary Examiner*—Tho v Duong
(74) *Attorney, Agent, or Firm*—Jordan and Hamburg LLP

(57) ABSTRACT

This invention is structured by:
forming a core body by turning-up a strip-shaped metal plate in fanfold manner to create a large number of flat flow passages; blocking the individual flow passages at both ends thereof using the respective comb teeth of a pair of comb-state members; and fitting the casing to the core body, while providing inlet/outlet port of the fluid at a side face of the casing. The object of the invention is to establish uniform communication of the fluid in individual flat flow passages. As a means for achieving the object, a pair of header portions are provided at both end portions of the cylindrical casing, the inlet/outlet ports are provided at both edge portions of one side of the casing via a pair of small tank portions, the small tank portion at inlet side of the first fluid has a buffer plate arranged at a position closer to the outlet side of the first fluid between the core body and the inlet/outlet port, thereby allowing the first fluid to bypass the buffer plate in the small tank portion and to enter an end portion of the first flow passage from an edge opposite to the outlet.

2 Claims, 6 Drawing Sheets

U.S. PATENT DOCUMENTS

| | | | | |
|---|---|---|---|---|
| 6,102,111 | A | 8/2000 | Kamio et al. | |
| 6,141,961 | A | 11/2000 | Rinckel | |
| 6,269,870 | B1 * | 8/2001 | Banzhaf et al. | 165/158 |
| 6,293,337 | B1 * | 9/2001 | Strahle et al. | 165/166 |
| 6,321,835 | B1 | 11/2001 | Damsohn et al. | |
| 6,408,941 | B1 * | 6/2002 | Zuo | 165/165 |
| 6,807,955 | B2 | 10/2004 | Leedham et al. | |
| 6,898,930 | B2 | 5/2005 | Nakatani et al. | |
| 6,976,480 | B2 | 12/2005 | Miyoshi et al. | |
| 6,997,250 | B2 * | 2/2006 | Dilley et al. | 165/174 |
| 7,032,577 | B2 | 4/2006 | Rosin et al. | |
| 7,077,190 | B2 | 7/2006 | Hayashi et al. | |
| 7,159,649 | B2 * | 1/2007 | Thyrum et al. | 165/165 |
| 7,168,419 | B2 | 1/2007 | Rosin et al. | |
| 7,204,302 | B2 | 4/2007 | Shibagaki et al. | |
| 7,284,599 | B2 * | 10/2007 | Karoliussen | 165/165 |
| 7,287,579 | B2 | 10/2007 | Dilley et al. | |
| 7,311,090 | B2 | 12/2007 | Lyons | |
| 7,438,062 | B2 | 10/2008 | Okawa et al. | |
| 2005/0121173 | A1 | 6/2005 | Inagaki et al. | |
| 2006/0048926 | A1 * | 3/2006 | Richter | 165/165 |
| 2007/0289581 | A1 | 12/2007 | Nakamura | |
| 2008/0135221 | A1 | 6/2008 | Nakamura | |
| 2009/0194265 | A1 | 8/2009 | Nakamura | |

FOREIGN PATENT DOCUMENTS

| | | |
|---|---|---|
| EP | 1 164 280 | 12/2001 |
| EP | 1363012 | 11/2003 |
| EP | 1555421 | 7/2005 |
| EP | 1630403 | 3/2006 |
| EP | 1746263 | 1/2007 |
| JP | 60-147097 | 8/1985 |
| JP | 60-150468 | 8/1985 |
| JP | 63-088212 | 4/1988 |
| JP | 5-018634 | 1/1993 |
| JP | 10-122768 | 5/1998 |
| JP | 2001-141388 | 5/2001 |
| JP | 2002-318095 | 10/2002 |
| JP | 2004-257366 | 9/2004 |
| JP | 2004-278351 | 10/2004 |
| WO | WO-02/10574 | 2/2002 |
| WO | WO-2004/065876 | 8/2004 |

* cited by examiner

HEAT EXCHANGER

BACKGROUND OF THE INVENTION

The present invention relates to a heat exchanger in a simple structure which can be applied to a heat exchanger (EGR cooler) used in an exhaust gas recirculation apparatus in an automobile and other heat exchangers, in which a core body formed by bending a strip-shaped metal plate in a fanfold manner, and having flat first flow passages and second flow passages alternately in the thickness direction of the metal plate, each of the first flow passages of the core body being blocked by each tooth of a pair of comb-state members at both end positions.

A conventional EGR cooler is made of an assembly of a large number of flat tubes or a large number of plates, a large number of fins, a casing and a header, in which cooling water is made to communicate through the casing side and an exhaust gas is made to communicate inside each of the flat tubes or the like as proposed in the invention described in Japanese Patent Application Laid-Open No. 5-18634.

Another heat exchanger is proposed in which a core of the heat exchanger is formed by a strip-shaped metal plate bent in a fanfold manner and a pair of comb-state members, the outer periphery being fitted with a cylindrical casing, and tanks are provided at both ends thereof in the longitudinal direction and as in the invention described in WO 2004/065876 A1.

In the former heat exchanger such as the EGR cooler, the number of parts is large, which makes assembling cumbersome and increases the number of brazing portions on the parts, and there is a problem that a leakage tends to occur at the brazing portion.

In the latter heat exchanger, the core body is formed in a shape of turning-up in a fanfold state to create a plurality of flat groove portions, while providing the first flow passage and the second flow passage alternately, the first flow passage being provided with a comb tooth of a comb-state member, thus joining the groove bottom with the front end of the comb tooth. And the casing is fitted with the outer periphery of the core body. The casing is made of a channel-state member covering the three sides of outer periphery of the core body and a lid member to close the opening of the channel-state member, being formed into a cylindrical shape, while both ends thereof are connected to headers. A pair of cooling water tanks are located at both end portions of the lid member, thus the cooling water communicates into the respective first flow passages of the core body through the inlet/outlet pipes attached to both ends of the lid member. The exhaust gas communicates through the second flow passage, thus the heat exchange is conducted between the exhaust gas and the cooling water.

According to an experiment of the inventors of the present invention, however, in the latter heat exchanger, when the inlet/outlet pipes and one of the inlet/outlet ports of the first flow passage face with each other, the first fluid flowing in and out from the inlet/outlet pipes tends to flow in an excessive amount at the inlet/outlet pipe side during flowing through individual first flow passages. The phenomenon leads to non-uniform flow of the first fluid in individual flow passages, which induces remaining of the first fluid at a portion of the flow passage. Thus, the heat exchange at the stagnant fluid portion decreases to generate overheating portion, which is a defective phenomenon.

To this point, the present invention aims to solve the above problems.

SUMMARY OF THE INVENTION

The present invention in accordance with a first aspect of the invention is a heat exchanger comprising a core body (5) in which a strip-shaped metal plate is turned up and bent in a fanfold manner with turned-up end edges (1), (2) alternately formed at one end and the other end of a rectangular flat face portion (1*a*), and flat first flow passages (3) and second flow passages (4) are provided alternately in the thickness direction of the metal plate, each of the first flow passages (3) of the core body (5) being blocked by each comb tooth (6*b*) of a pair of comb-state members (6) at both end positions of the turned-up end edge (1), and a fin (7) being set between the second flow passages (4) so as to constitute a core (8), the outer periphery of the core body (5) being fitted with a cylindrical casing (9) so as to block the adjacent turned-up end edges (1), (2), a first fluid (10) being guided to each of the first flow passages (3) by a pair of inlet/outlet ports (11) on the outer face of the casing (9), while a second fluid (12) being guided from one of cylindrical openings (13) of the casing (9) to the other opening (13) through each of the second flow passages (4), wherein a pair of header portions (31) are provided at both end portions of the casing (9) having a cylindrical shape, the inlet/outlet ports (11) are provided at both end portions of one side of the casing (9) via a pair of small tank portions (28), the small tank portion (28) at inlet side of the first fluid (10) has a buffer plate (30) between the core body (5) and the inlet/outlet port (11) at a position closer to the outlet side of the first fluid (10), thereby allowing the first fluid (10) to bypass the buffer plate (30) in the small tank portion (28) and to enter an end portion of the first flow passage (3) from an edge opposite to the outlet.

The present invention in accordance with a second aspect of the invention is the heat exchanger in accordance with a first aspect of the invention, wherein in each of the comb-state members (6), its tooth base (6*c*) crosses perpendicularly with each of the comb teeth (6*b*), a root (14) of each comb tooth (6*b*) is bent in the L-shape along the tooth base (6*c*), the plane of the tooth base (6*c*) is in contact with the turned-up end edge (2) at each end of the core body (5), while the inlet of the first flow passage (3) is opened on an edge portion of the tooth base (6*c*) at the root side of each comb tooth.

The present invention in accordance with a third aspect of the invention is the heat exchanger in accordance with the first or second aspect of the invention, wherein the heat exchanger is an EGR cooler, the first fluid is cooling water, and the second fluid is exhaust gas.

The heat exchanger of the present invention is constructed as above and has the following effects.

According to the present invention, inlet/outlet ports 11 are provided at the end portions of one side of the casing 9 via small tank portions 28, and a buffer plate 30 is provided in each of the small tank portions 28, thereby the first fluid 10 bypasses the buffer plate 30 to uniformly communicate into the individual portions in the first flow passage 3 to enhance the heat exchange. Since the inlet of the first flow passage 3 is formed to open in a slit shape narrower than the small tank portion 28, the velocity of the first fluid 10 entering through the opening increases. The kinetic energy of the first fluid 10 allows the first fluid 10 to reach a position distant from the lid member 9*b*. That is, the first fluid 10 enters the first flow passage 3 bypassing the buffer plate 30 and in a squeezed state.

With the above structure, when the plane of the tooth base 6*c* of the comb-state member 6 is in contact with the turned-up end edge 2 of the core body 5 at each end of the core body 5, and when the inlet of the first flow passage 3 is opened at the edge portion of the tooth base 6*c* at the root side of each comb tooth, a portion of the first fluid 10 bypassing the buffer plate 30 and entering the first flow passage 3 enters inside along the L-shape portion at the root of the comb tooth, and then is guided by the straight portion of each comb tooth to smoothly reach the edge portion in the width direction of the flat face of the first flow passage. Thereby the first fluid 10 uniformly communicates through the individual portions in the first flow passage 3 to enhance the heat exchange.

With the above structure, when the heat exchanger is used as the EGR cooler, the local boiling of cooling water can effectively be prevented.

DETAILED DESCRIPTION OF THE INVENTION

Next, embodiments of the present invention will be described based on the attached drawings.

Figure 1:
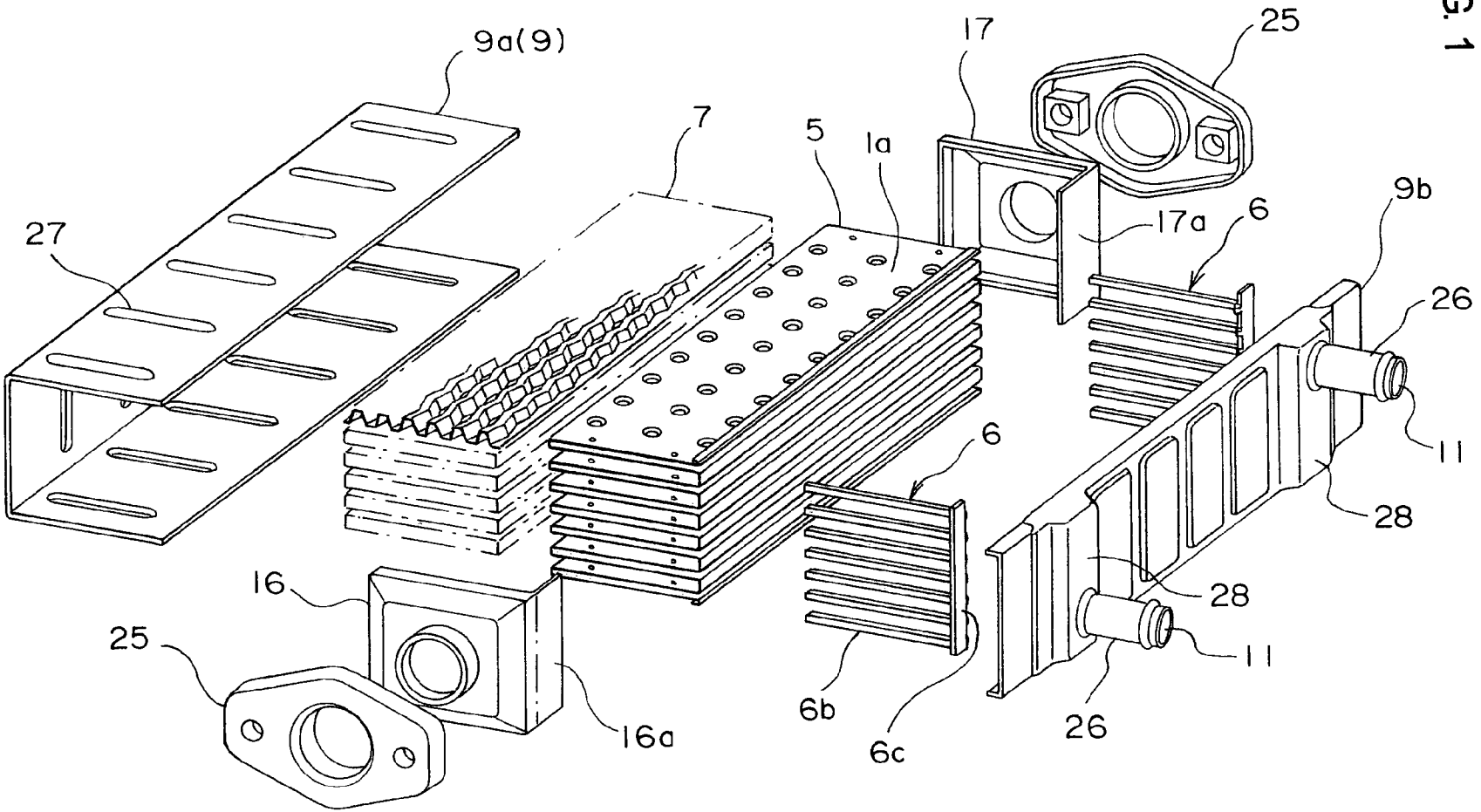
FIG. 1 is an exploded perspective view of a heat exchanger of the present invention.
Figure 2:
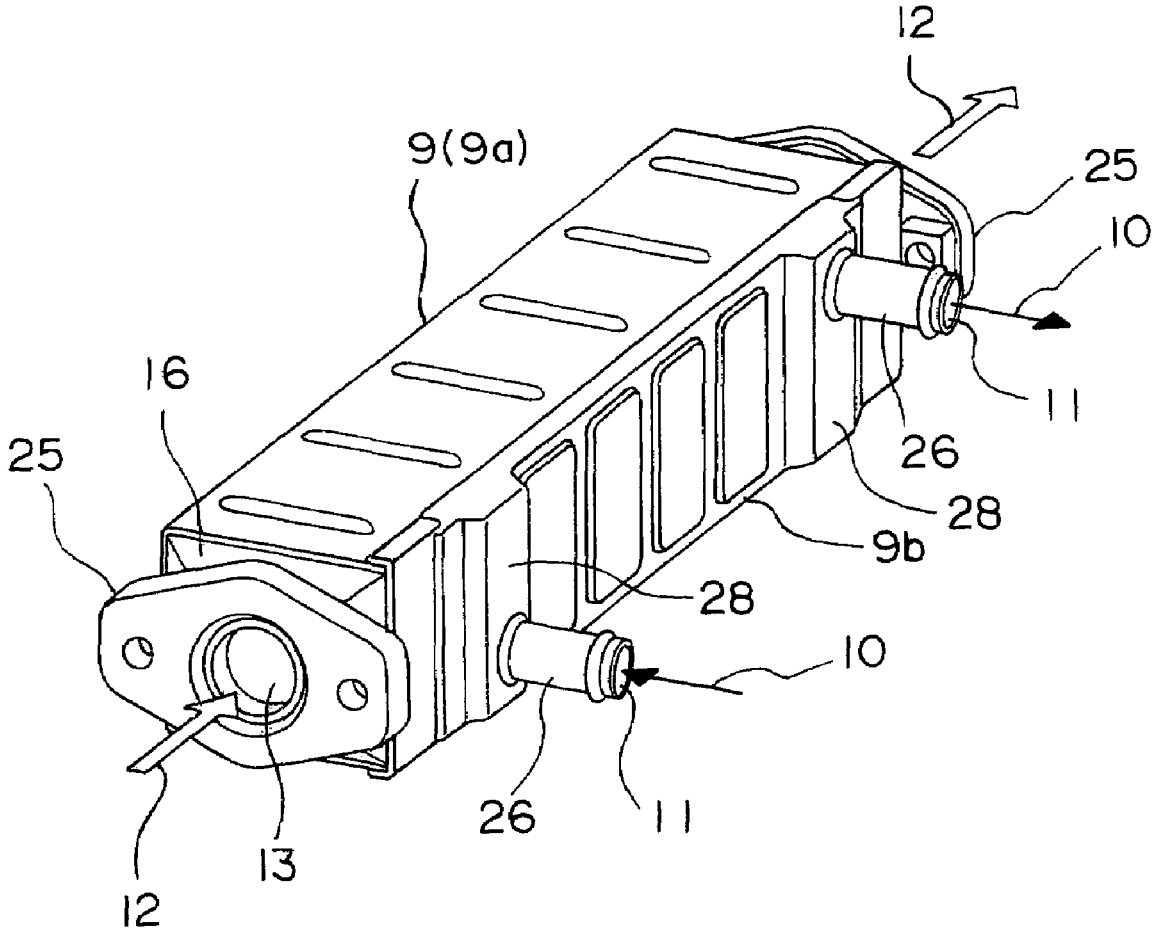
FIG. 2 is a perspective view illustrating an assembled state of the heat exchanger.
Figure 3:
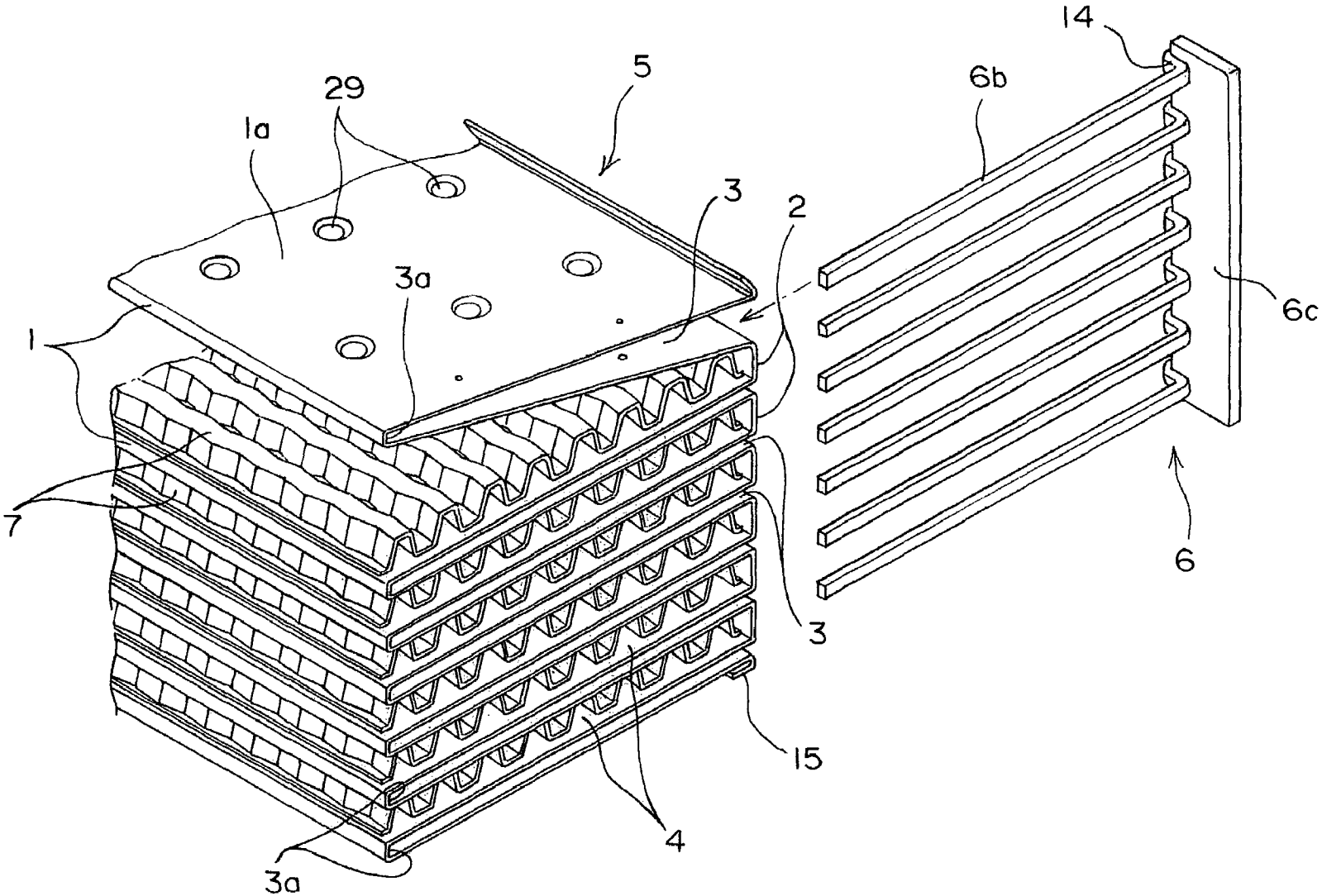
FIG. 3 is an explanatory view of an assembly of a core body 5 and a comb-state member 6 of the heat exchanger.
Figure 4:
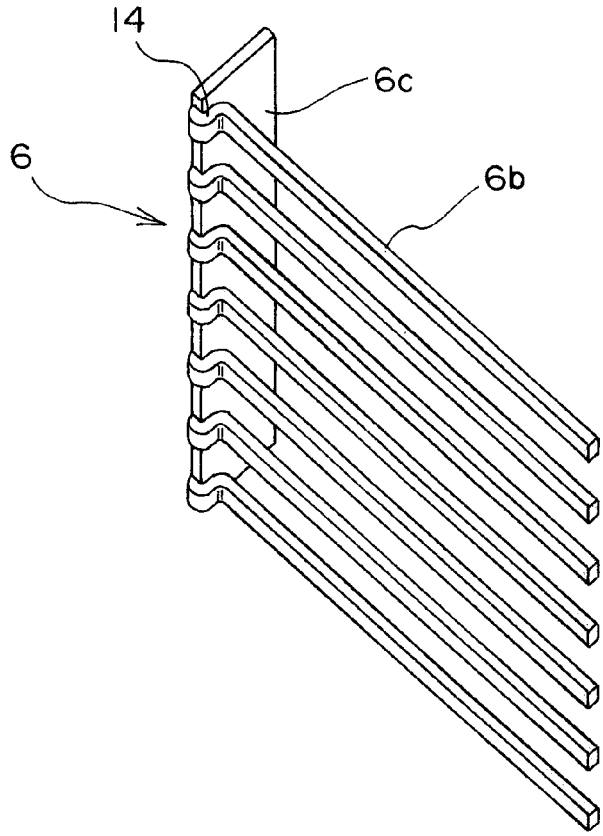
FIG. 4 is a perspective view of the comb-state member 6.
Figure 5:
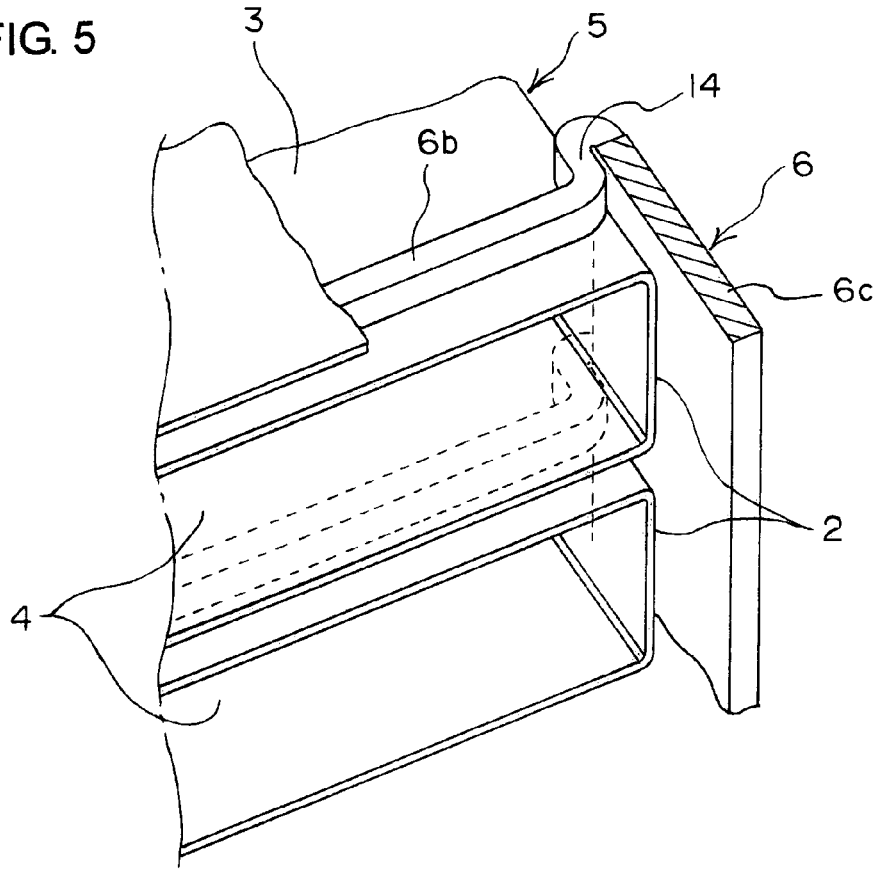
FIG. 5 is an enlarged perspective view of essential parts illustrating a state where the comb-state member 6 is inserted into the core body 5.
Figure 6:
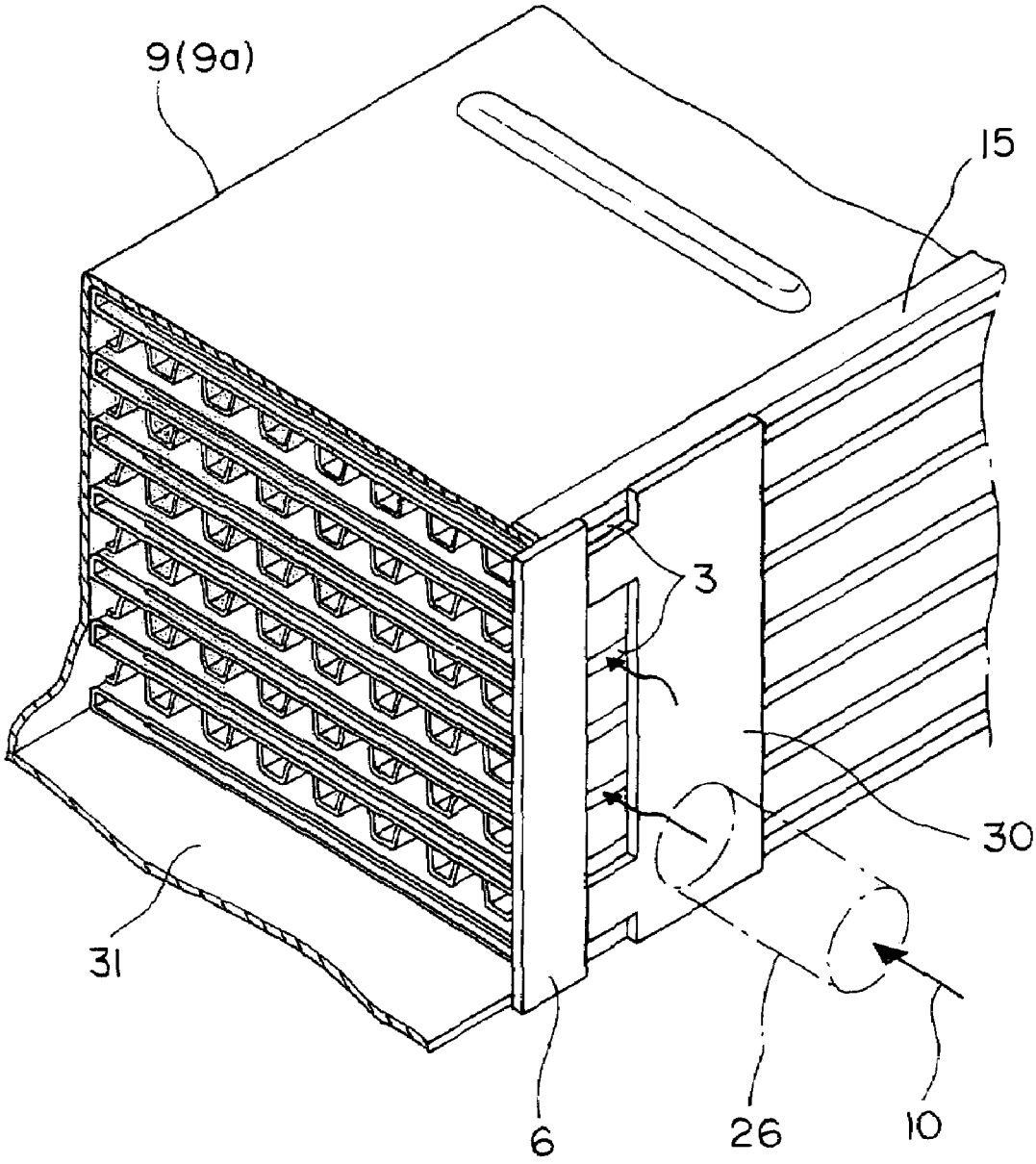
FIG. 6 is a perspective view illustrating principal of the heat exchanger according to the present invention.
Figure 7:
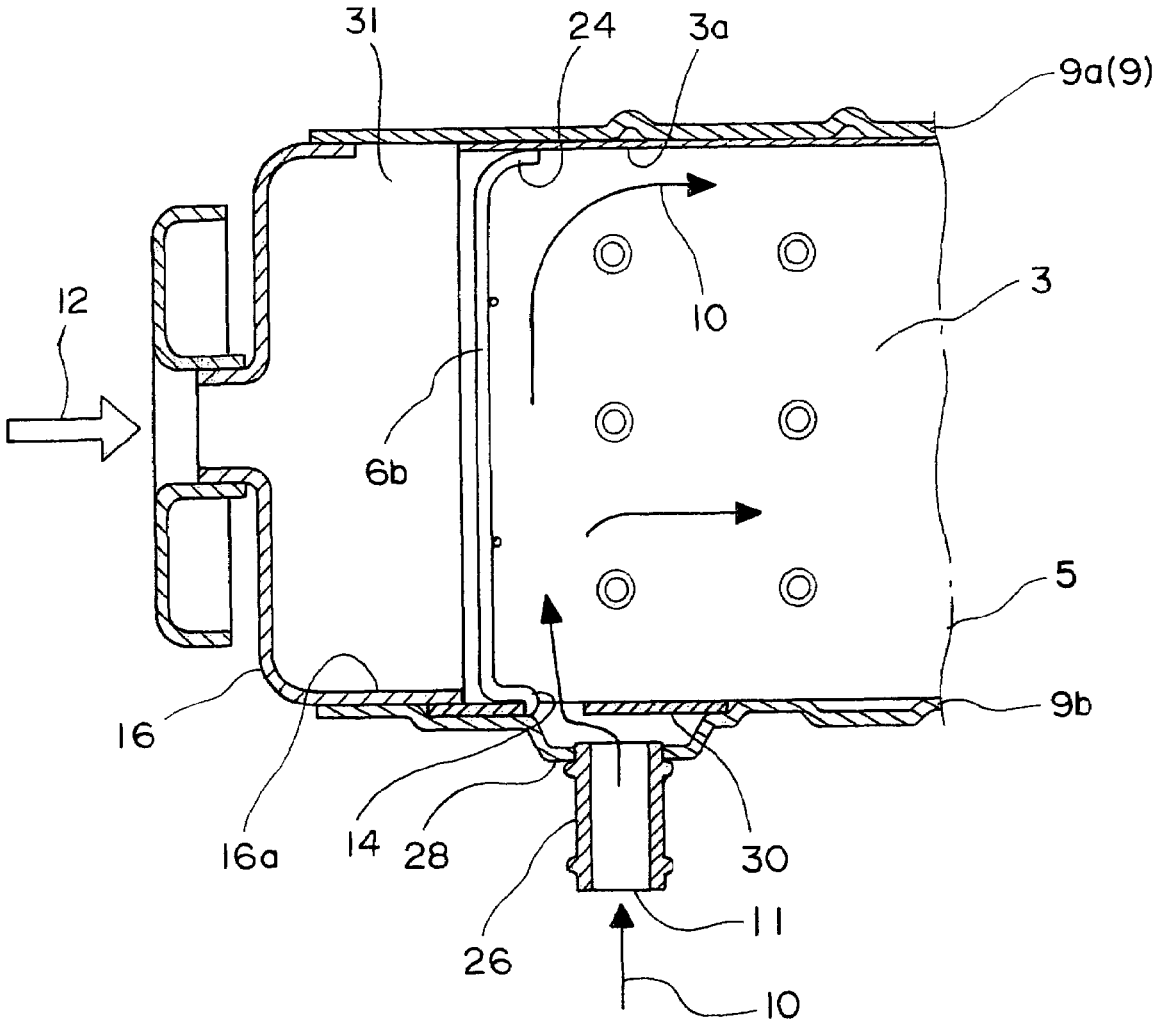
FIG. 7 is a principal part longitudinal cross sectional plan view of the heat exchanger.

FIG. 1 is an exploded perspective view of a heat exchanger of the present invention, FIG. 2 shows its assembled state and FIG. 3 is an explanatory view of an assembly of a core body 5 and a comb-state member 6. Also, FIG. 4 is a perspective view of the comb-state member, FIG. 5 is a partially cutaway enlarged perspective view illustrating the assembled state, FIG. 6 is a perspective view of a principal part of the invention in a partially assembled state, and FIG. 7 is a principal part longitudinal cross sectional view of the invention.

This heat exchanger has a core body 5, a large number of fins 7, a casing 9, a pair of headers 16, 17, and the pair of comb-state members 6.

The core body 5 is formed by turning up and bending a strip-shaped metal plate in a fanfold manner as shown in FIG. 3 so that turned-up end edges 1, 2 are formed alternately at one end and the other end of a rectangular flat face portion 1*a*, and flat first flow passages 3 and second flow passages 4 are provided alternately in the thickness direction of the metal plate. In this example, a space of the first flow passage 3 is formed smaller than that of the second flow passage 4. It is needless to say that the spaces of the both can be the same or vice versa.

A large number of dimples 29 are formed on the first flow passage 3 side of the strip-shaped metal plate. In this example, the opposing dimples 29 are brought into contact with each other at their tip ends so as to hold the space of the first flow passage 3 constant. To each of the first flow passages 3, each comb-state member 6 is fitted at the both end positions of the turned-up end edges 1, and the fitted portions are integrally brazed/fixed. Also, instead of the dimples, an inner fin may be inserted into the first flow passage 3 and the inner face and both sides in the thickness direction of the inner fin may be brazed/fixed together.

In the comb-state member 6, a tooth base 6*c* is provided at a right angle with a comb tooth 6*b*, and a root 14 of the comb tooth 6*b* is bent in the L-shape along the comb base 6*c* (FIGS. 4, 5).

The comb-state member 6 constructed as above, as shown in FIG. 5, has its tooth base 6*c* in contact with the end face of the turned-up end edge 2, and the root 14 is in contact with the corner part so that a brazed area of each contact portion is large. By this, reliability of brazing is improved.

The root 14 and the tooth base 6*c* are manufactured in contact or with an extremely slight gap.

Next, the fins 7 are set between each of the second flow passages 4 as shown in FIG. 3. Though the first flow passage 3 at the uppermost position is shown in the lifted state in FIG. 3 so that the fin 7 is easy to be seen, the lower face side of the first flow passage 3 at the uppermost position is actually in contact with the fin 7 on the uppermost stage as shown in FIG. 6. This fin 7 is formed by bending a metal plate in the wave-form in the cross sectional direction and also in the longitudinal direction of its ridge line and trough portion so as to improve agitating effect of a fluid communicating through the second flow passage 4.

A core 8 in FIG. 6 is constituted by an assembly of the core body 5, the comb-state member 6 and the fin 7 as above. Instead of the above fin 7, a slit fin, an offset fin or a louver fin, not shown, may be inserted into the second flow passage 4.

The casing 9 to fit on the outer periphery of the core 8 is formed to have a thickness larger than the thickness of the core to increase the strength. Along with that, the casing 9 is formed into a cylindrical shape in square cross section having a longer side than the length of the core 8, and has a pair of header portions 31 on outer side of both ends of the core 8, (see FIG. 7). This casing 9 is comprised by a channel-state member 9*a* and a lid member 9*b* as shown in FIGS. 1 and 2.

The channel-state member 9*a* has its inner circumferential face in contact with both the upper and lower faces and one side of the core body 5 so as to block between the adjacent turned-up end edges 1 of the core body 5. The lid member 9*b* blocks the opening side of the channel-state member 9*a*, blocks the other side of the core body 5 and blocks between the adjacent turned-up end edges 2. The channel-state member 9*a* is made of high heat-resistant/corrosion-resistant nickel steel, stainless steel or the like and prevents damage from a high-temperature exhaust gas as a second fluid 12 communicating through the inner surface. On the other hand, since cooling water as a first fluid 10 communicates through the inner surface of the lid member 9*b*, it may have poorer heat resistance or corrosion resistance than those of the channel-state member 9*a*. In general, stainless steel plate with poorer heat resistance or corrosion resistance has better forming performance than that of the high heat-resistant/corrosion-resistant material and is inexpensive. In this embodiment, the lid member 9*b* is formed with a pair of small tank portions 28 projected by press work on the outer face side at the both end positions as shown in FIG. 1, in which inlet/outlet ports 11 are opened, respectively, and pipes 26 are connected to the ports 11. By using a stainless steel plate with poor heat resistance/corrosion resistance to some degree as the lid member 9*b*, processing of this small tank portion 28 is facilitated.

The tip end edges of the both side walls of the channel-state member 9*a* are fitted to fitting edge portion 15 (FIG. 6) turned up and formed in U-shape cross section at both upper and lower ends of the core body 5. In addition, the L-shape portion formed by bending perpendicularly at top and bottom ends of the lid member 9*b* is fitted on the outer face of the fitting edge portion 15.

FIG. 6 and FIG. 7 show the principal part of the present invention. The buffer plate 30 is provided at inlet side of the first fluid 10, thus allowing the cooling water to uniformly communicate through each portion of the first flow passage 3. If the buffer plate 30 does not exist, since a pair of small tank portions 28 are arranged at both ends of the lid member 9*b*, the first fluid 10 entering from the pipe 26 tends to flow in larger amount to the lid member 9*b* side on communicating through the individual first flow passages 3. Therefore, the buffer plate 30 is arranged to face the opposite side of the outlet of the cooling water in the pipe 26, thus forming a slit opening only at the left side in FIG. 7, thereby increasing the flow velocity of the first fluid 10 flowing out from the opening. The kinetic energy of the first fluid 10 allows the first fluid 10 to reach a position distant from the lid member 9*b*. That is, the first fluid 10 enters the first flow passage 3 bypassing the buffer plate 30 and in a squeezed state.

At both ends of the core body 5, the plane of the tooth base 6*c* of the comb-state member 6 is in contact with the turned-up end edge 2 of the core body 5, and the inlet of the first flow passage 3 is opened at an edge portion of the tooth base 6*c* at the root 14 side of the individual comb teeth 6*b*. Therefore, a portion of the first fluid 10 bypassing the buffer plate 30 and entering the first flow passage 3 enters inside along the L-shape portion at the root 14 of the comb teeth, and then is guided by the straight portion of each comb tooth 6*b* to smoothly reach the end portion in the width direction of the flat face of the first flow passage 3. By this, the first fluid 10 uniformly communicates through the individual portions in the first flow passage 3 to enhance the heat exchange. A pair of comb-state members 6 (FIG. 1) constitute header plates. This comb-state member 6 can have its tip end portion formed in a curved portion 24 as shown in FIG. 7, and in this case, the flow of the first fluid 10 can be smoothly guided in the longitudinal direction at the end of the comb-state member 6. By this, a remained portion of the first fluid 10 can be eliminated, and if the first fluid 10 is cooling water, boiling at that part can be prevented, and heat exchange can be promoted.

Next, referring to FIG. 6 and FIG. 7, opening ends of the header portions 31 of the both ends of the casing 9 in the longitudinal direction are blocked by a pair of header end lids 16, 17 made of a high heat-resistant/corrosion-resistant material, and a flange 25 is fitted to the outside. The header end lids 16, 17 are swollen outward in the pot shape in this embodiment, and an inlet/outlet port for the second fluid 12 is opened at the center. Moreover, on one side of each of the header end lids 16, 17, extension portions 16*a*, 17*a* are integrally extended and the extension portions 16*a*, 17*a* cover the inner surfaces of the both ends of the lid member 9*b* as shown in FIG. 7.

A brazing material covers or is arranged at each connection portion of this heat exchanger, and the whole in the assembled state shown in FIG. 2 is integrally brazed/fixed in a high-temperature furnace.

And the first fluid 10 is supplied to the first flow passage 3 side, while the second fluid 12 is supplied to the second flow passage 4 side. When the heat exchanger is used as an EGR cooler, the first fluid 10 made of cooling water is supplied to each of the first flow passages 3 through one of the pipes 26 and the small tank portions 28 projected on one side of the casing 9 and it communicates in the longitudinal direction and flows out of the other pipe 26. Also, the second fluid 12 made of a high-temperature exhaust gas is supplied to each of the second flow passages 4 from the opening of the header end lid 16 through an opening 13 of the casing 9.

The invention claimed is:

1. A heat exchanger comprising a core body in the shape of a rectangular solid have opposed flat face portions and comprised of a strip-shaped metal plate turned up and bent in a fanfold manner with turned-up end edges alternately formed at one face and an opposed face of the rectangular shaped solid; and flat first flow passages and second flow passages are provided alternately in the thickness direction of the core body formed of the fan-folded metal plate, the first and second flow passages open on opposite first and second end positions of the core body;

first and second comb-state members, each comb-state member having a tooth base and a plurality of comb teeth, the bases in contact with and their surfaces parallel with the turned up edges on one face and the comb teeth having root portions and, distal the root portions, tip portions, the root portions bent at the tooth base to be parallel with the turned-up end edges of the core body, wherein each of the first flow passages of the core body is blocked by a comb tooth of the pair of comb-state members at both end positions of said turned-up end edges and the tip portions of the comb teeth bent to protrude into the respective first flow passages;

a fin set within said second flow passages;

a cylindrical casing having a first end portion and a second end portion, wherein an outer periphery of the core body is fitted with the cylindrical casing so as to block adjacent turned-up end edges, the first end portion being proximal to a first comb-state member of the pair of comb-state members;

a pair of small tank portions provided on an outer face of the cylindrical casing each small tank portion of the pair of small tank portions having an exterior opening and an interior opening opposed to the exterior opening, the interior opening of each small tank portion fluidly connecting to the first flow passages in the core body, a first small tank portion of the pair of small tank portions provided proximal to the first end portion of the cylindrical tank and a second small tank portion of the pair of small tank portions provided proximal to the second end portion of the cylindrical tank;

an inlet port fluidly connected to the exterior opening of the first small tank portion;

an outlet port fluidly connected to the exterior opening of the second small tank portion, wherein a first fluid is guided to each of the first flow passages by the inlet port and guided from each of the first flow passages by the outlet port;

a pair of cylindrical openings provided on the cylindrical casing, wherein a second fluid is guided from a first cylindrical opening of the pair of cylindrical openings to a second cylindrical opening of the pair of cylindrical openings;

a header portion having a cylindrical shape provided at each of the end portions of said cylindrical casing;

a buffer plate provided on the core body positioned such that the buffer plate obstructs a flow of the first fluid through the first small tank portion from flowing through a portion of the interior opening of the first small tank portion opposing the exterior opening of the first small tank portion, the buffer plate forming a first edge of an inlet passage for each of the first flow passages, the first edge of the inlet passage being closer to an outlet passage than a second edge of the inlet passage, the inlet passage fluidly connecting the first flow passages and the first small tank portion so as to divert and guide the flow of the first fluid toward the comb tooth of the first comb-state member in each of the first flow passages, the outlet passage fluidly connecting the first flow passage to the second small tank portion, wherein wherein all contact surfaces between the structural elements recited above are brazed.

2. The heat exchanger according to claim 1, wherein said heat exchanger is an EGR cooler, the first fluid is cooling water, and the second fluid is exhaust gas.

* * * * *